United States Patent [19]

Trivett

[11] Patent Number: 5,069,806

[45] Date of Patent: Dec. 3, 1991

[54] SOLID DRY FILM PRELUBE WITH LOW TEMPERATURE CLEANABILITY

[75] Inventor: Robert L. Trivett, Aurora, Ill.

[73] Assignee: Nalco Chemical Company, Naperville, Ill.

[21] Appl. No.: 664,392

[22] Filed: Mar. 4, 1991

Related U.S. Application Data

[63] Continuation-in-part of Ser. No. 428,904, Oct. 27, 1989, abandoned.

[51] Int. Cl.[5] ..... C10M 129/74

[52] U.S. Cl. ..... 252/52 A; 252/56 S; 72/42

[58] Field of Search ..... 252/52 A, 56 S; 72/42

[56] References Cited

U.S. PATENT DOCUMENTS

| | | | |
|---|---|---|---|
| 4,588,511 | 5/1986 | Frentrup | 252/52 R |
| 4,752,405 | 6/1988 | Kyle | 252/52 A |
| 4,753,743 | 6/1988 | Sech | 252/33.4 |
| 4,767,551 | 8/1988 | Hunt | 252/32.7 E |
| 4,824,586 | 4/1989 | Johnson | 252/52 A |
| 4,846,986 | 6/1989 | Trivett | 252/56 R |

*Primary Examiner*—Jacqueline V. Howard

*Attorney, Agent, or Firm*—Kinzer, Plyer, Dorn, McEachran & Jambor

[57] ABSTRACT

Dry prelubricating composition for steel substrates to be fabricated comprising a polyhydric alcohol-carboxylic acid lubricant derived from a saturated ester, a partially esterified vegetable oil plasticizer, an aromatic polyether surfactant and preferably, in addition, an ethylenic polymeric film strengthener and hindered phenolic antioxidant. The composition is to be transformed to the liquid state by rendering it molten or dissolving it, then applied to the substrate (hot) and subsequently cooled to provide a prelubricating film which is removable by treatment with an alkaline solution.

12 Claims, 7 Drawing Sheets

Sech (4,753,743)

72 hours/Cleveland Cabinet

Nalco Lubricant #1

72 hours/Cleveland Cabinet

Sech (4,753,743)

72 hours/Cleveland Cabinet

Nalco Lubricant #1

72 hours/Cleveland Cabinet

Sech (4,753,743)
(5.0% Sech EO Additive)
72 hours/Cleveland Cabinet

Sech (4,753,743)
(15.0% Sech EO Additive)
72 hours/Cleveland Cabinet

Nalco Lubricant #1
(7.5% EO/PO Additive)
72 hours/Cleveland Cabinet

Nalco Lubricant #1
(15.0% EO/PO Additive)
72 hours/Cleveland Cabinet

Nalco Lubricant #1
(5.0% Sech EO Additive)
72 hours/Cleveland Cabinet

Sech (4,753,743)

130°F Cleanability

Nalco Lubricant #1
130°F Cleanability

Nalco Lubricant #1
(5.0% Sech EO Additive)
130°F Cleanability

Sech (4,753,743)
(15.0% Sech EO Additive)
130°F Cleanability

Nalco Lubricant #1
(7.5% EO/PO Additive)
130°F Cleanability

Nalco Lubricant #1
(15.0% EO/PO Additive)
130°F Cleanability

Sech (4,753,743)
(5.0% Sech EO Additive)
130°F Cleanability

SOLID DRY FILM PRELUBE WITH LOW TEMPERATURE CLEANABILITY

This application is a continuation-in-part of application Ser. No. 07/428,904 filed Oct. 27, 1989, now abandoned.

TECHNICAL FIELD OF THE INVENTION

The present invention is in the technical field of metalworking operations and the lubricants used therein, particularly solid film (dry film) prelubes for steel in automotive and appliance applications.

BACKGROUND OF THE INVENTION

Lubricants are generally applied in many metalworking operations. Such operations include stamping, drawing, forming, rolling, bending, cutting, grinding, punching, spinning, extruding, coining, hobbing, swagging and the like. The present invention concerns solid film (dry film) lubricants for such type of metalworking operations, and in particular, such operations as employed in automotive and appliance applications. In the automotive and appliance fields, the term "stamping" is used as a broad term to cover all press working operations on sheet metal, which operations may be further categorized as drawing, cutting, or coining. Automotive and appliance stamped parts may be produced by one of a combination of these three fundamental fabrication operations.

Metalworking lubricants, especially solid film (dry film) prelubes, facilitate these operations generally be reducing friction between the metal being worked and the element (tooling) employed for that process, and thus reducing the power for a given operation, reducing the wear of the surfaces of the work elements (tooling) employed that perform the necessary operation on the metals, and preventing sticking (adhesion) between the metal being worked and the work elements (tooling) operating thereon or between metal pieces during storage, handling or operations.

In automotive and appliance applications, the prevention of sticking (adhesion) between metal pieces and between such pieces and the work elements is of extreme importance. In addition, the use of specific metalworking lubricants such as solid film (dry film) prelubes significantly reduce or eliminate the production of scrap parts which often result from the failure of some lubricants to perform the necessary functions described above. Metalworking lubricants, including solid film (dry film) prelubes, often provide corrosion protection to the metal being processed and protection to such metal during storage and transportation.

In many metalworking processes, including automotive and appliance applications, coils or rolls of steel, in particular cold roll or specific types of galvanized steel sheets including hot dip galvanized, galvaneal and electrogalvanized, are cut into pieces call blanks. Such blanks are stamped or drawn to produce the desired finished parts. Such automotive parts formed by stamping or drawing, as these terms are generally used, include hoods, floor pans, deck lids, fenders, quarter panels, oil pans, fuel tanks, inner and outer door panels, tops and the like. Appliance parts formed by stamping and drawing include, as these terms are generally used, including washer tops, dryer tops, washer fronts, dryer fronts, top and front lids, oven liners, oven tops and dryer tumblers (backs and fronts), and the like. Prior to the use of lubricants known as prelubes (oil-based or solid film) the normal procedure was to apply and oil at the steel mill to such coils or rolls as a rust preventative (mill or slushing oils) prior to shipping to a processing site, such as a stamping plant. Between the steps of cutting such coils or rolls of steel into pieces called blanks and the stamping or drawing operation, such rust preventative oil would be removed by a cleaning operation (blank wash oil or alkaline cleaner) and a drawing lubricant then applied to the metal and at such times the work element (tooling) immediately prior to stamping or drawing. Such drawing lubricant is used to reduce friction and facilitate the metalworking operation to produce the desired finished part.

In recent times, the use of separate rust preventative oils and drawing lubricants has been in many operations replaced by the use of a single composition known as a prelube. Prelubes, whether oil-based or solid film, are generally applied at the steel mill during either temper rolling or inspection, as would be a rust preventative oil, prior to shipping. Such compositions are thus not intentionally removed from the metal until after the blanks are out and the parts formed. Thus, the use of such prelubes eliminates the tedious process of applying and removing the combination of rust preventative oils and drawing lubricants before further working with one composition (whether oil-based or solid film).

Prelubes thus must function as both a rust preventative and forming lubricant. In many instances, and particularly for automotive and appliance applications, a prelube must be removable with aqueous alkaline cleaners, non-staining to the metal and compatible with all other chemical compositions utilized in the processing operations in producing the products in question.

To prevent interference with future processing operations after the desired part is formed, it is necessary for all traces of the prelube composition to be effectively removed from the metal surface of the formed part. The advantages and efficiencies offered by prelubes, especially solid film lubricants, would be partially diminished or nullified if unusual or drastic elements were necessary to remove the prelube film from the finished part. In both the automotive and appliance industries, aqueous alkaline cleaners are the normal chemical compositions used to remove all lubricant compositions from the surfaces of the finished part.

These cleaners are usually powdered in form and composed of various mixtures of inorganic alkalais and biodegradable surfactants and amines. Such compositions are water soluble at the recommended dilutions and are strongly alkaline in nature (pH of 10.0–12.0). These cleaners are heavy duty in nature and designed in concept to effectively remove all traces of processing lubricants and fluids from a wide variety of metallic surface including those composed of ferrous steel, zinc, zinc-aluminum, zinc-iron and aluminum alloys. Finished parts are cleaned in a variety of cleaning systems using spray, immersion and combinations of both types. Such cleaner compositions are applied to parts for varying time increments, often 30 seconds to three minutes for spray systems and 1.0 to 5.0 minutes for immersion systems. Such cleaner compositions effectively operate over a wide temperature application range. Finished appliance parts are cleaned at temperatures varying from 140°–190° F. Automotive parts have been traditionally cleaned over a temperature range of 120° F. to 145° F.

Newer chemical compositions are now being used on a variety of automotive finished parts at lower temperatures, varying from 105° F. to 125° F. Such alkaline cleaner compositions allow for better economics associated with lower operating costs, and furthermore, the lower temperatures offer benefits in being more compatible with the variety of galvanized steels used to produce finished parts and such temperatures also are more compatible with future processing operations beyond the cleaning system. Many prelube compositions may contain chemical constituents that cannot be easily removed with such alkaline cleaners, thereby creating serious detrimental effects on all future processing operations and effectively limiting their use.

One major purpose and advantage of the present invention is the improved cleanability and removability for a solid film (dry film) prelube in both automotive and appliance industries at the lower temperature ranges of 120° to 140° F. and yet the maintenance of all other desired performance properties associated with such invention on a wide variety of metal substrates including ferrous, zinc-coated and non-ferrous for automotive and appliance industries.

Concerning metal staining, steel coils or rolls coated with prelube compositions may be stored for long periods of time before their use as bases for finished parts. Many chemical constituents of such prelube compositions can oxidize to varying degrees during those storage periods, and the oxidation reaction by-products can adversely affect the metal surface. For instance, the oxidation of hydrocarbon oil components to fatty acid by-products can stain, discolor and damage some forms of prelube substrates. Appliance and automotive industries require prelube compositions that will protect metal substrates during these potential storage periods against such oxidation conditions and effectively be non-staining.

Concerning the compatibility with other processing chemical compositions, many parts formed in automotive and appliance industries often have severe bends formed during the metalworking operations. These severe bends may have exceedingly tight radii such as in hem flanges where traces of prelube compositions can become entrapped. Thus, although the prelube compositions may be effectively removed from all exposed part surfaces, the entrapped portions may remain and be volatilized and released by subsequent processing operations. This potential release of the prelube composition necessitates that such compositions be compatible with cathodic electrocoat paint primers and bonding body adhesives used in automotive industries and porcelain enamel operations in the appliance industries. Many automotive finished parts are now being attached together by the use of bonding adhesives where welding methods are no longer suitable or desirable.

Appliance parts are often coated with porcelain enamel coatings to improve quality and durability of such finished parts. Most appliance and automotive formed parts are coming into contact with processing chemical compositions after the metalworking operation, and thus the prelube compositions improve their overall utilization and efficiency by being compatible with such processing compositions.

The majority of prelubes used commercially in the automotive and appliance industries today are compositions composed of petroleum hydrocarbon oils and additives and such compositions are fluid at ambient temperatures. Because of their fluid nature, these hydrocarbon oil-base compositions can drain off metal surfaces (depending on substrate orientation), become unevenly distributed on metal substrate surfaces due to capillary action or tend to pool or collect in hem flange areas becoming heavily concentrated in such areas. All of these conditions can have a drastic effect on prelube performance as the uniformity of the film on the metal substrate is critical to corrosion protection and the necessary lubrication for successful forming. Thus, the automotive and appliance industries demand a prelube that provides the desirable film uniformity that will provide adequate corrosion protection during the long term conditions of storage and transit, and furthermore, provide the critical film strength and performance demanded for successful forming operations, especially those required for severe drawing operations.

Further, with these hydrocarbon oil-based prelube compositions, housekeeping and cleanliness are extremely hard to maintain, both at the steel manufacturers where the product is applied and at the forming plant where the composition is used. These compositions leak onto tooling surfaces, machine surfaces and onto the floor creating hazardous work environments for all employees involved. Such compositions often contaminate floor waste trenches and plant waste treatment stream. Often these prelube compositions can volatilize into the plant environment creating health hazards and safety concerns. These oil-based compositions can often create dermatitis among workers exposed to such compositions for varying periods of time. Thus, at least the automotive and appliance industries demand a prelube that reduces or eliminates these problems.

In addition, a prelube composition that can be used at reduced levels and still provide the necessary performance parameters of corrosion protection and forming lubrication would be highly desirable. In the automotive and appliance industries, such oil-based prelube automotive and appliance applied at coverage rates up to 1,000–2,000 mg/ft$^2$. The automotive and appliance industries desire a prelube composition that offers all the necessary benefits but will offer such benefits at a lower coating weight (coverage rate), thus improving the overall cost efficiency of that forming operation.

In addition, a prelube composition must be compatible with the current waste treatment processes being used to treat waste lubricants. The automotive and appliance industries desire a prelube that will be compatible with the current treatment processes and furthermore, offer some advantages to those processes.

It is an object of the present invention to provide a metalworking lubricant, and more particularly a solid dry film prelube that provides all of the foregoing desirable characteristics, and advantages especially improved low temperature cleanability, for all metalworking applications but especially for the automotive and appliance industries. It is a further object of the present invention to provide a method of lubricating various types of metal substrates, particularly cold roll steel and a variety of galvanized substrates including hot dip galvanized, electrogalvanized, galvaneal and galvalume, for all stamping and drawing operations especially those of the automotive and appliance industries, that provides all of the foregoing desired advantages. These and other objects of the invention are described below.

DISCLOSURE OF THE INVENTION

Figure 1:
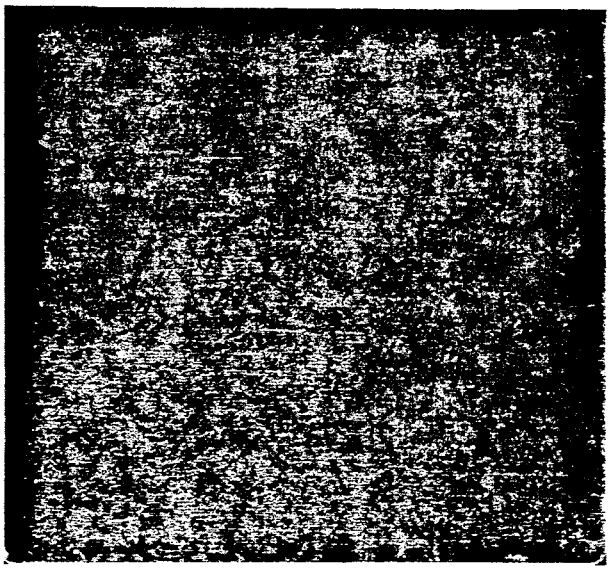
FIGS. 1 through 14 are photographs (each as "photo" herein) showing the results of testing thirteen formulations A through M hereinafter described.
Figure 2:
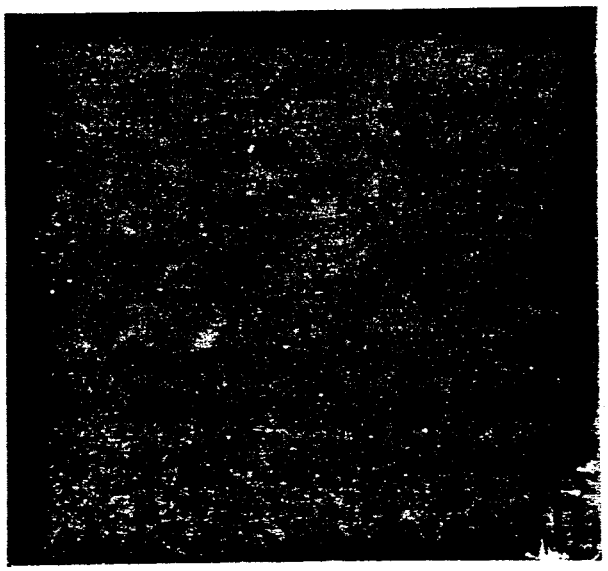
Figure 3:
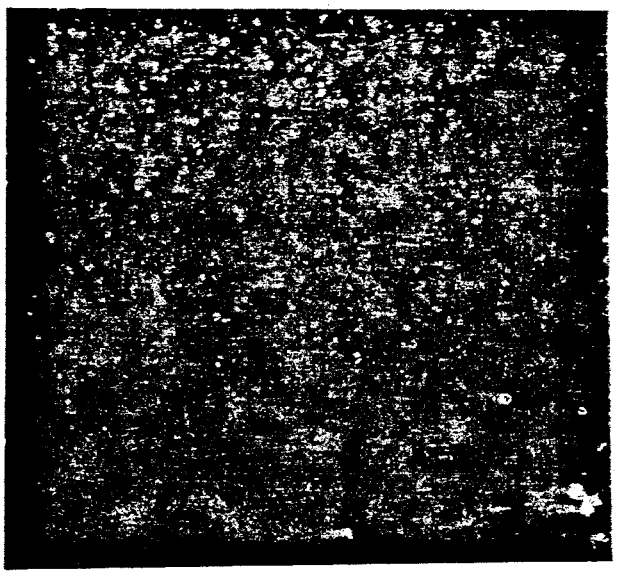
Figure 4:
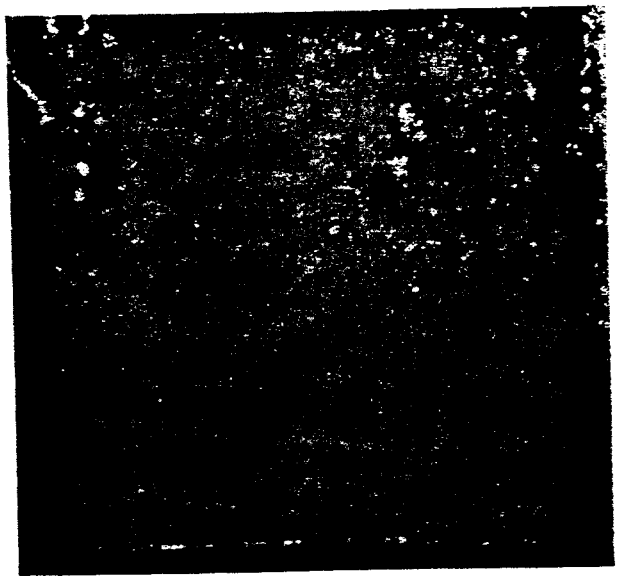
Figure 5:
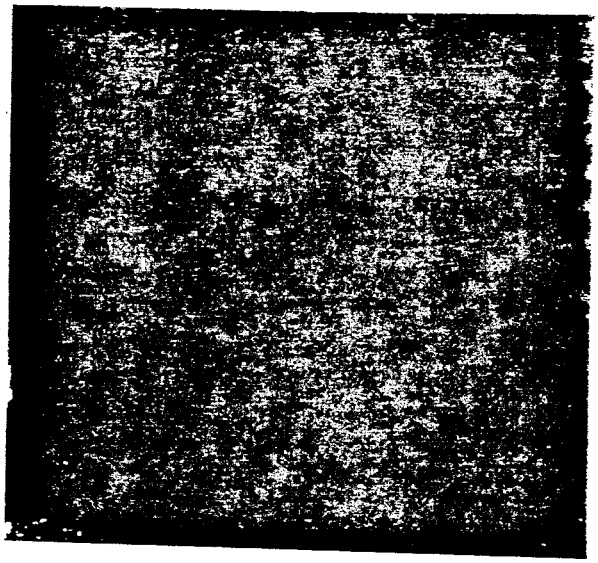
Figure 6:
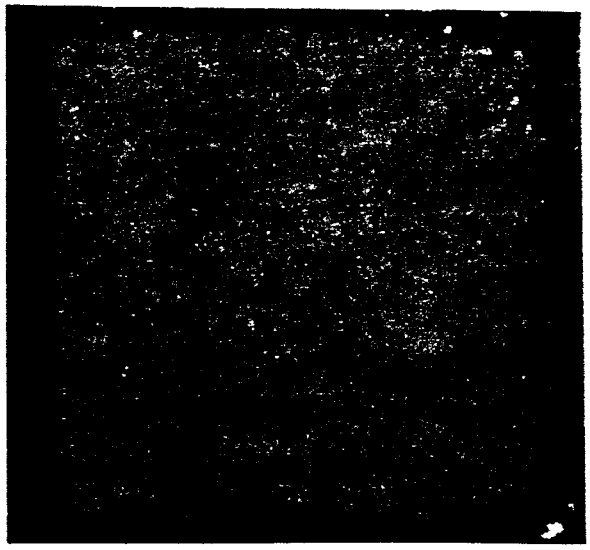
Figure 7:
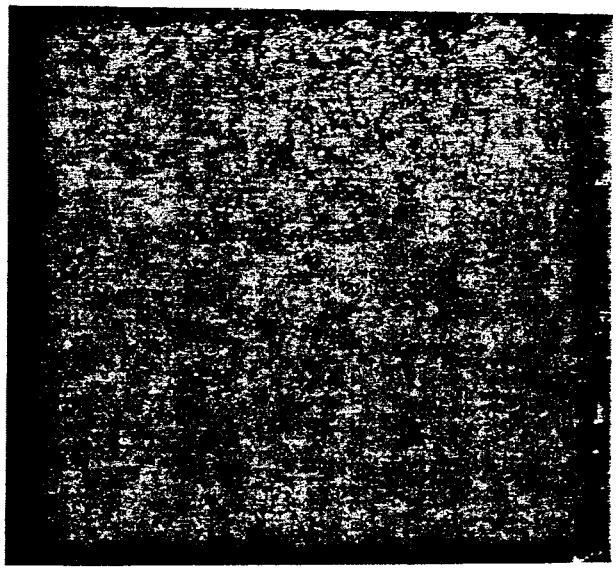
Figure 8:
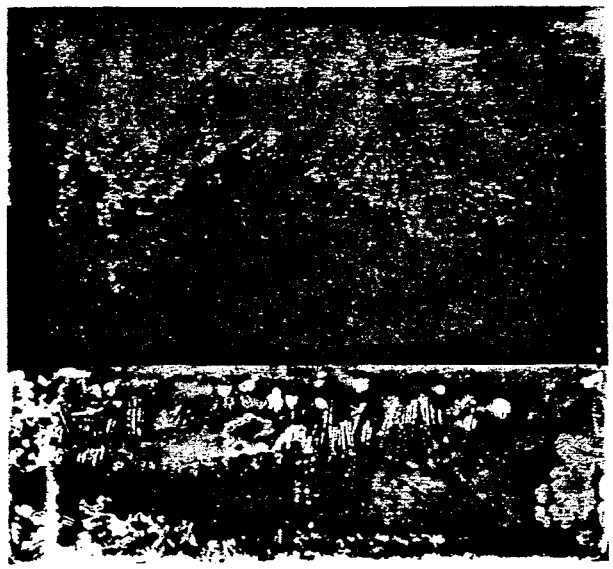
Figure 9:
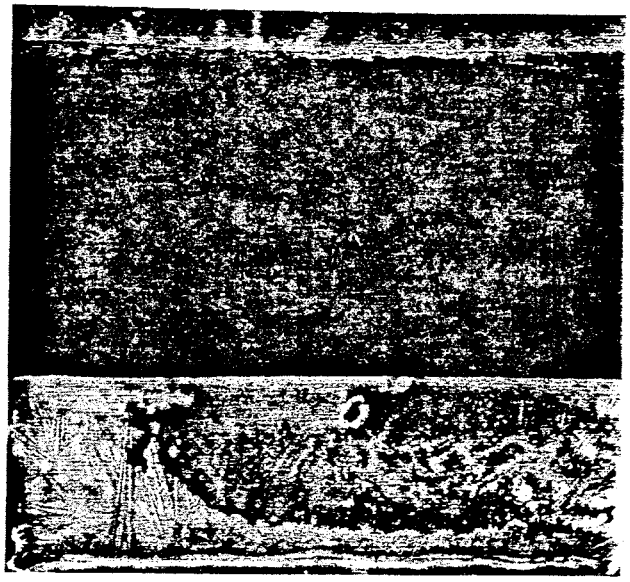
Figure 10:
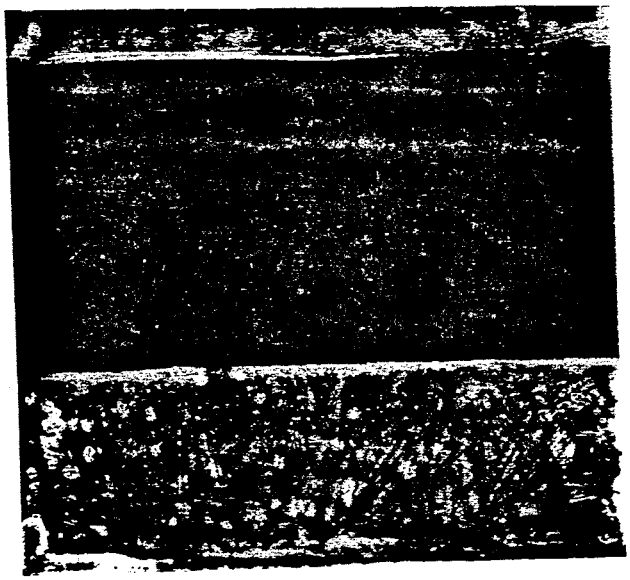
Figure 11:
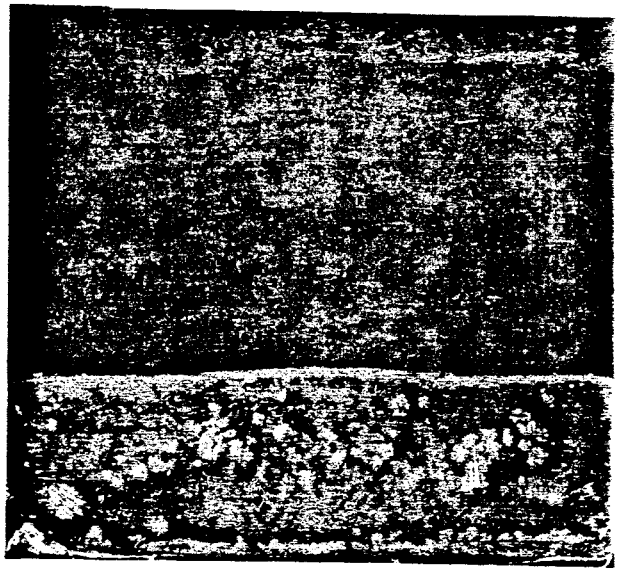
Figure 12:
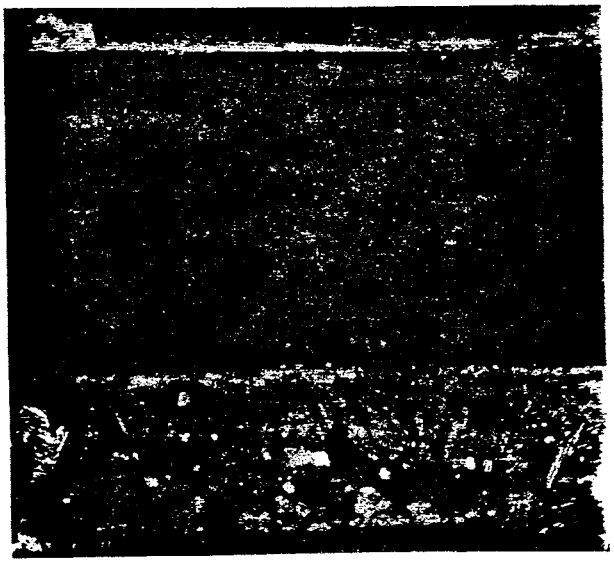
Figure 13:
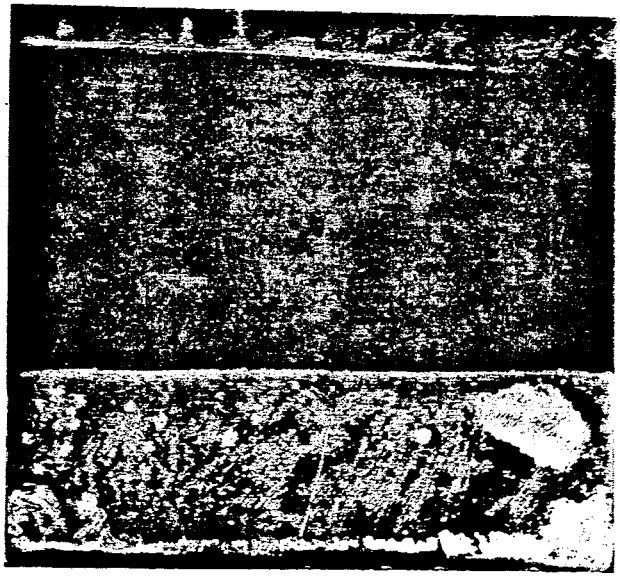
Figure 14:
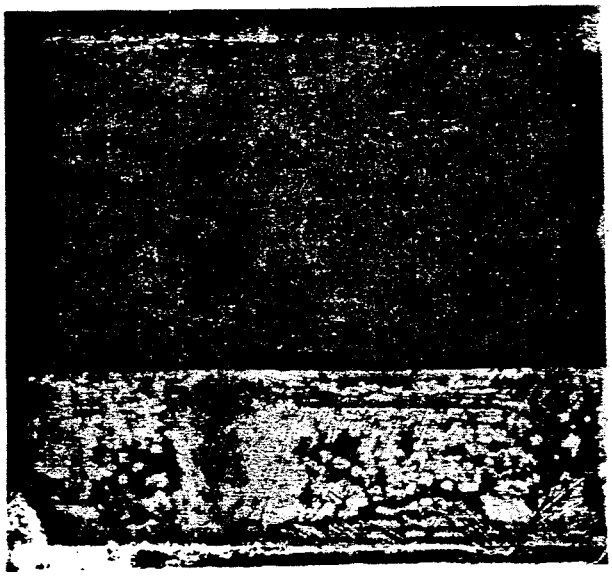

The present invention provides a lubricant for metalworking in a solid film prelube with improved low temperature cleanability. In can easily be applied in a molten form via a rollcoater system to an incoming warm metal substrate moving at varying speeds. A series of warm ovens are used to reflow the solid film prelube followed by a water quench to reduce coating temperature to ambient conditions.

Examples of satisfactory ingredients for a solid film prelube composition are provides in U.S. Pat. No. 4,753,743 and U.S. Pat. No. 4,846,986 assigned to Nalco Chemical Company (herein Nalco) incorporated herein by reference.

The preferred lubricant includes at least one substantially saturated refined ester formed of a polyhydric alcohol and at least one carboxylic acid (lubricant), from 4.0 to 14.0 weight percent of a partially esterified vegetable oil (plasticizer), a surfactant which may be a modified aromatic polyether, stearamide alkanolamide, isostearamide alkanolamide, an aspartic acid diester and oleic acid imidazoline or mixtures thereof and from 0.1 to 2.0 weight percent of an ethylene and homopolymer film strengthener, a polymer derived from ethylene and ethylenically unsaturated carboxylic acid monomers, oxidized derivatives of ethylene polymers, or mixtures thereof.

In preferred embodiments, the substantially saturated ester is formed of an aliphatic polyhydric alcohol having from 2.0 to 10.0 carbon atoms and aliphatic monocarboxylic acids having from 2.0 to 26.0 carbon atoms. The aliphatic monocarboxylic acids preferably have substantially unbranched carbon chains. The refined ester has a melting point of from 30° to 100° C.

In more preferred embodiments, the substantially saturated refined ester is a diglyceride or triglyceride formed with carboxylic acids at least 90 percent of which have carbon chains containing from 14 to 22 carbon atoms. A very preferred embodiment is a triglyceride, the substantially refined hydrogenated triglyceride derived from tallow is a composition having an acid number from 0.1 to 9.0, a composition having a saponification number of 150.0–250.0 particularly having an acid number from 0.1 to 5.0 and a saponification number of 190.0–210.0.

In further preferred embodiments, the partially esterified vegetable oil is derived from castor oil, soybean oil, rape seed oil, cottonseed oil or mixtures thereof.

The modified aromatic polyether is formed of a 10.0 to 20.0 carbon alcohol and from 5.0 to 15.0 moles of ethylene oxide per mole of alcohol and 10.0–20.0 moles of propylene oxide per mole of alcohol. More preferably, the alcohol is a 14.0 to 16.0 carbon aromatic alcohol reacted with about 9.0 moles of ethylene oxide per mole of alcohol and about 15.0 moles of propylene oxide per mole of alcohol. The specific composition is a clear liquid at ambient temperature with a cloud point of 20.0°–24.0° C. in deionized water.

The stearamide alkanolamide is formed of a reaction between one mole of stearic acid and one mole of monoethanolamine. The fatty acid alkanolamide is granular in appearance with nonionic character. In further embodiments, the stearic acid amide has an acid value less than 1.0, alkalai value of 5.0 to 18.0 and a melting point of 87° C. The isostearamide alkanolamide is formed of a reaction between one mole of isostearic acid and one mole of diethanolamine. The fatty acid alkanolamide is liquid in appearance with nonionic character. In further embodiments, the isostearic amide has an acid value of 5.0 to 10.0, alkalai value of 30.0 to 60.0 and specific gravity of 0.96.

In preferred embodiments, the aspartic acid diester - oleic acid imidazoline blend is primarily a mixture of a di-ester of L-aspartic acid and an imidazoline based on the reaction between oleic acid and amino ethyl ethanolamine. Aspartic acid diester oleyl imidazoline is composition having an acid value of 50.0 to 100.0 and an alkalai value of 5.0 to 50.0 and is a fluid composition at ambient temperature, particularly having an acid value of 65.0 to 75.0 and an alkalai value of 30.0 to 40.0.

In preferred embodiments, the ethylene homopolymer is a polymer derived of ethylene and ethylenically unsaturated carboxylic acid monomers, oxidized derivatives and mixtures thereof. Such ethylene homopolymer is a composition having a melting point between 85° to 115° C., acid value of 70.0 to 140.0 and hardness from 9.0 to 22.0 dmm at 25° C.

In further embodiments, such copolymer of ethylene and acrylic acid has a hardness of 12.0 to 16.0 dmm at 25° C., acid number from 110.0 to 130.0 and a melting point of 90° to 100° C.

The lubricant preferably contains from 80.0 to 90.0 weight percent of at least one substantially refined saturated ester formed of an aliphatic polyhydric alcohol having from 10.0 to 20.0 carbon atoms and aliphatic monocarboxylic acids having from 2.0 to 26.0 carbon atoms. The most preferred lubricant composition has:

From 80.0 to 90.0 weight percent of one substantially refined saturated ester formed of polyhydric alcohol and at least one carboxylic acid;

An effective plasticizing amount, comprising from 4.0 to 14.0 weight percent of a partially esterfied vegetable oil formed with an organic diacid having a molecular weight of from 250 to 500;

An effective surfactant amount for cleanability comprising from 2.0 to 6.0 weight percent of a modified aromatic polyether resulting from reaction of $C_{10}$–$C_{20}$ alcohol with ethylene oxide and propylene oxide;

An isostearic acid-diethanolamine alkanolamide, stearic acid-monoethanol amine alkanolamide, aspartic acid diester-oleyl imidazoline blend or mixtures thereof;

From 0.1 to 2.0 weight percent of an ethylene homopolymer derived from ethylene and ethylenically unsaturated carboxylic acid monomers, oxidized derivatives of ethylene polymer, or mixtures thereof, such polymers having a molecular weight in excess of 2,000.

These and other preferred embodiments are described in more detail below.

ANTIOXIDANTS

The lubricant may further includes from 0.1 to 3.0 weight percent of an antioxidant, particularly a hindered phenol type.

METHOD OF APPLICATION

The lubricant may be applied by dipping, rollcoating or electrostatic spraying. After the lubricant has been applied and cooled to ambient temperature, the lubricant coating will be a solid prelube lubricant film. The preferred method of coating involves applying the lubricant in a molten form (liquid at 165°-180° F.) to a moving steel strip (speeds of 100 to 3,000 feet/minute) via a series of two or three coating rolls on each side of the steel strip. The moving metal strip comes into the coating setups at a temperature of 135°-175° F. A chrome pickup roll in each setup transfers the lubricant from the coating pan to one or two rubber coating rolls which apply the lubricant to the steel strip. Specific coating weights down to a range of $+/-5$ mg/ft$^2$ can be achieved by combining several factors: speed of moving strip, peak metal temperature of moving strip, speed of coating rolls, gaps and pressures of rolls on each other and on the steel strip and lubricant temperature. Quartz lights are used to keep all roll setups above liquid temperature of the lubricant. The coated steel strip is passed through a series of ovens to reflow the coating and then cool it. Exiting the oven, the moving coated strip is sprayed by a waterfall quench at ambient temperature to cool the strip to ambient temperature before coiling of the coated metal strip.

PREFERRED EMBODIMENTS OF THE INVENTION

The lubricant, according to the present invention, is a solid film (dry film) coating with improved low temperature cleanability particularly useful in many types of metalworking (stamping and forming) operations and especially suitable as a prelube for metalworking operations in the automotive and appliance industries. This coating is characterized as a solid film (dry film) because it is applied as a molten liquid to a metal substrate and upon cooling forms a hard, pliable, solid coating on that metal substrate. Such coating can also be referred to as a hot melt coating. This coating can also be referred to as a dry film prelube because in its applied form as a solid coating, it is devoid of any fluid like properties. Both the appliance and automotive industries utilize many parts that are produced by stamping and drawing operations, parts that may be produced by one or a combination of metalworking operations, which may be subcategorized under cutting, drawing and coining. Lubricants, especially solid film prelubes, can be employed during these stamping and forming operations to reduce the necessary power required, reduce or eliminate wear of the work elements (tooling) and the possibility of the metal parts being worked to adhere to the tooling or each other.

In addition, it is desirable that the lubricant offer corrosion protection on the metal part during formation, storage and transportation. In some metalworking operations, especially in the appliance and automotive industries, it is advantageous to apply a lubricant coating to steel coil or onto sheets of steel, both before they are shipped to the metalworking plant. Such applications should take place during the final stages of temper rolling or inspection. Corrosion protection should be offered during the storage and transportation to the metalworking plant where such lubricant also offers the necessary lubrication for all subsequent stamping and forming operations. As mentioned earlier, such lubricants are called prelubes and they must function as both corrosion preventatives and lubricants, one product replacing a variety of multitude of products used in the part. The lubricant, according to the present invention as described in more detail below, is one that is solid at ambient temperature and is applied to the metal substrate in a molten liquid form. As the metal substrate and the lubricant cool, a uniform and homogeneous solid lubricant coating remains on the metal substrate.

In addition, such prelube compositions must be easily and readily removable with the standard aqueous alkaline cleaners used in the appliance and automotive industries. There has been a strong trend toward the use of lower temperature cleaners, especially in the automotive industry. It is the purpose of this invention to be more cleanable at these lower temperatures of 120°-140° F. Cleanability is extremely important because trace amounts of prelube composition can interfere with all future processing operations including phosphate coating and the application of electrocoat paint primer coatings and paint top coats. If trace amounts are left on the metal substrate, they should have minimal to no effect on these processing operations.

Furthermore, all of the above properties are highly dependent upon the uniform application of a prelube composition onto the metal substrate. The performance properties of all prelube compositions, especially solid film prelubes, are greatly enhanced by a uniform and consistent coating on the metal substrate until such time during which the composition is removed. The lubricant, according to the present invention, offers this important advantage in that it is a solid, homogeneous and consistent coating which is retained on the metal substrate until which time removability is called for.

The lubricant, according to the present invention, contains at least one substantially highly refined saturated ester which is formed of a polyhydric alcohol and at least one carboxylic acid. Such refined esters generally will comprise a large percentage of the lubricant and provide two important performance parameters for the lubricant: inherent lubricity and the wetting and film-forming properties of the lubricant upon the metal substrates. In preferred embodiments, such esters have melting points of 30° C. to 100° C. (86° F. to 212° F.). Most importantly, the selection of such refined esters and other lubricant components will provide a solid film lubricant that is significantly a solid coating at ambient room temperature and yet at elevated temperatures above its melting point can be applied onto a metal substrate in a molten form and form a solid, uniform and homogeneous coating upon the substrate upon cooling to ambient temperature conditions.

The polyhydric alcohol portion of such refined esters preferably are aliphatic alcohols such as ethylene glycol, glycerol, pentaerythritol and the like, preferably being polyhydric alcohols having from 2 to 10 carbon atoms. The carboxylic acids forming the refined esters are preferably aliphatic monocarboxylic acids and more preferably are such acids comprised of from 2 to 26 carbon atoms, containing mixtures of branched and unbranched carbon chains, but preferably the unbranched carbon chain moieties will predominate.

In preferred embodiments the refined esters are substantially saturated mixtures of diglycerides and triglycerides formed with carboxylic acids at least 90% have carbon chains containing from 14 to 22 carbon atoms. A particularly useful refined ester is one formed substantially of the trihydric glycerol and carboxylic acids of which at least 90% have carbon chains of 16 to 18 carbon atoms, such as the substantially refined hydrogenated triglyceride derived from tallow, having a melting point of about 62° C. (145° F.) and wherein about 30% of the carboxylate chains are those having 16 carbon atoms and about 65% are those having 18 carbon atoms, the remainder being chains of 14 carbons (2%), 15 carbon atoms (0.5%) and 17 carbon atoms (2.5%)

In addition to the substantially refined saturated esters, it is necessary to add additional flexibility to the lubricant coating to improve coating adhesion and performance. To improve flexibility, the lubricant, according to the present invention, further contains from 4.0 to 14.0 percent weight of certain polar compositions and of high viscosities at the elevated temperatures required to render the lubricant molten and be compatible with the substantially refined saturated esters. As mentioned earlier, such compositions are partially-esterified vegetable oils or air-oxidized vegetable oils. Suitable vegetable oils from which partial esters and air-oxidized derivatives can be derived include castor oil, soybean oil, rape seed oil, cotton oil and the like. Preferably these partial esters are formed with organic diacids having molecular weights ranging from 250.0 to 500.0. A particularly useful composition is a partially-esterified castor oil derivative having an acid number of about 45.0 to 60.0, most preferably about 50.0 and formed by the partial esterification of castor oil with an organic diacid of about 340.0 to 360.0 molecular weight by methods known currently in the industry. The above compositions are known to behave as plasticizers for the substantially refined unsaturated esters, providing the necessary degree of film flexibility to the lubricant for a uniform and homogeneous coating which will adhere to the metal substrate.

Further, such plasticizer compositions, when blended with the refined esters in the lubricant of the present invention, are totally compatible with such esters and improve the functional properties of the present invention.

The lubricant, according to the present invention, also contains from 0.1 to 2.0 weight percent of a polymeric composition comprises of an ethylene homopolymer. Such polymer composition is derived from the polymerization of ethylene and ethylenically unsaturated carboxylic monomers, oxidized derivatives of such ethylene polymers and mixtures thereof. Such polymeric compositions preferably have molecular weights in excess of 2,000.0 and melting points of from 85° C. to 115° C. (185° to 239° F.). These polymer compositions have been found to enhance and improve film strength of the prelube coating and together with the substantially refined saturated esters and the certain plasticizing compositions described above, result in a lubricant coating on the metal substrate that has superior film strength and lubrication for metalworking operations, especially stamping and forming operations in the automotive and appliance industries.

In preferred embodiments, such polymer has a hardness of from 9 to 22 dmm (25° C.) and an acid number of from 70.0 to 140.0 (mg KOH/g). A particularly useful polymer is an ethylene based polymer comprised of units derived from ethylene and acrylic acid, with a melting point of from 90° to 110° C., having a hardness of from 12.0 to 16.0 dmm (25° C.) and an acid number of from about 110.0 to 130.0.

The lubricant, according to the present invention, contains a surfactant to improve the removability of the prelube coating when such lubricant is exposed to an aqueous alkaline cleaner at 120° to 140° F. Such lubricant composition contains from 2.0 to 6.0 weight percent of a surfactant that improves cleanability whether such lubricant coating on the metal substrate is exposed to alkaline cleaner in an immersion or spray system. Such surfactant improves the cleanability of the present invention at lower temperatures versus past solid film prelubes but has no negative impact on the excellent performance properties of the lubricant coating, most importantly film adhesion, corrosion protection and lubrication. A particularly preferred surfactant is a modified aromatic polyether formed of an aromatic alcohol containing a hydrophobe carbon chain containing from 10.0 to 20.0 carbon atoms. Such aromatic alcohol is reacted with by means known in the industry and contains from 5.0 to 15.0 moles of ethylene oxide per mole of alcohol and from 10.0 to 20.0 moles of propylene oxide per mole of alcohol. A most particularly preferred surfactant is 14.0 to 16.0 carbon alcohol reacted with 9.0 moles of ethylene oxide per mole of alcohol and 15.0 moles of propylene oxide per mole of alcohol, with a cloud point of 20.0° to 24.0° C. in deionized water, a molecular weight of about 1,482.0 and the empirical formula of $C_{76}H_{150}O_{25}$.

Particularly useful stearamide alkanolamide surfactants are granular fatty acid alkanolamides formed from reaction of 1.0 mole of stearic acid and 1.0 mole monoethanolamine. In further embodiments, such amides have an acid value of less than 1.0, alkalai value of 5.0 to 8.0 and a melting point of 87° C.

A particularly useful isostearamide alkanolamide are liquid fatty acid alkanolamides formed from reaction of 1.0 mole of isostearic acid and 1.0 mole of diethanolamine. In further embodiments, such amides have an acid value of 5.0 to 10.0, alkalai values of 30.0 to 60.0 and a specific gravity of 0.96. A particularly useful fatty acid mixture is the blend of L-aspartic acid diester and oleic acid imidazoline, more specifically L-aspartic acid, N-(3-carboxy-1-oxo Z-propenyl) - (-N-octadecyl-), bis (2-methyl propyl) ester, Z and 1-H-imidazole-1-ethanol, 2-(hepta decenyl)-4, 5-dihydro. Such blend has an acid value of from 50.0 to 100.0, an alkalai value of 5.0–50.0 and is a fluid compositions at ambient temperature, particularly having an acid value of 65.0 to 75.0 and an alkalai value of 30.0 to 40.0.

Further, these surfactant compositions when blended with the substantially refined saturated esters, plasticizing compositions and polymeric components as described above have been found compatible and create no effects that are in any combination deleterious to the functional properties of the lubricant. In fact, these surfactant compositions improve lubricant performance by enhancing and improving the low temperature cleanability of the present invention.

The solid film lubricant, according to the present invention, provides a uniform, consistent and homogeneous film on the metal substrate that is retained during handling and working to a degree not achievable with oil-based lubricants. Once deposited on the substrate in a molten form and cooled to ambient temperature conditions, a solid film lubricant remains on the metal substrate. Due to the combination of film coating properties attributed to uniformity and strength by the lubricant, most severe stamping and drawing operations can be made in the automotive and appliance industries. Most operations can be made using a coating thickness (weight of lubricant per unit area basis) that is one-fifth to one-tenth of that required for conventional oil-based metalworking lubricants; thus a significant materials savings is achieved with the lubricant of the present invention. Further, as demonstrated below, the lubricant is easily removed with standard aqueous alkaline cleaners used in the automotive and appliance industries in the temperature range of 120° to 140° F., and thus offers material savings in being able to be removed at lower temperatures. Thus, it is compatible with the appliance industries. It has been found to be compatible with these processing operations including electrocoated paint primers and structural body adhesives used in the automotive industry. In addition, the lubricant of the present invention has been found to provide corrosion protection to all types of steel substrates that is better than conventional oil-based rust preventatives.

Finally, the lubricants is compatible with existing waste treatment processes and chemicals and offers material savings because lower coating weights means a reduced amount of lubricant is entering the waste treatment scheme for processing.

The lubricant, according to the present invention, contains from 0.1 to 3.0 weight percent of an antioxidant, such as a hindered phenol. Such an antioxidant is compatible with all components of the lubricant and provides an additional level of corrosion protection by reducing or eliminating the potential for lubricant staining of mild steels. The lubricant of the present invention might further include other additives but in preferred embodiment is limited to the components described above.

In a preferred embodiment, the lubricant is comprised of from 8.0 to 90.0 weight percent of at least one substantially refined saturated ester formed of an aliphatic polyhydric alcohol having from 2.0 to 10.0 carbon atoms and aliphatic monocarboxylic acid having from 2.0 to 26.0 carbon atoms, from 4.0 to 14.0 weight percent of the plasticizing compositions described above, from 0.1 to 2.0 weight percent of an ethyleneacrylic acid homopolymer and from 2.0 to 6.0 weight percent of the surfactant compositions described above. In further preferred embodiment, such lubricant may further contain from 0.1 to 3.0 weight percent of an antioxidant.

The lubricant of the present invention is particularly useful as a solid film prelube, particularly as a prelube for automotive and appliance applications. Its properties, however, may make it an excellent selection as a lubricant outside of such applications, and within such applications may also be applied to all work elements, tooling such as dies and the like.

The lubricant, according to the present invention, may advantageously be commercially coated by passing a moving metal substrate through a rollcoating setup consisting of a series of application rolls and bath of molten lubricant. Such substrate is then passed through a series of ovens to reflow the lubricant coating and cool the coating to ambient temperature conditions, followed by a water spray quench. Such lubricant can also be applied by brushing or applied in any manner suitable for a viscous, molten liquid including electrostatic spray.

The advantages and utility of the lubricant, according to the present invention, are further described in the following examples.

EXAMPLE 1

A lubricant, according to the present invention, was prepared as follows:

One blending vessel equipped with mechanical means of heating and stirring was used. The blending vessel is well insulated to allow for uniform heating and cooling.

The following ingredients were added and mixed in the vessel: 83.0 parts by weight of a refined hydrogenated triglyceride derived from, tallow, commercially available under the registered trademark of NEUSTRENE 060 from Humko Chemical Division of Witco Chemical Company; 10.0 parts by weight of an ester derivative of castor oil; 1.0 parts by weight of a hindered phenol antioxidant, commercially available under the tradename IONOL from Shell Oil Company; 1.0 parts by weight of an ethylene-acrylic acid copolymer, commercially available under the registered trademark of AC-143 and 5.0 parts by weight of a modified aromatic polyether, commercially available under the tradename of ANTAROX LF-222 from GAF Chemical Corporation.

The blend of components was heated with moderate agitation to 180° F. and stirred until all components have dissolved and the blend was uniform and homogeneous in color and appearance. Heat was than shut off and mixture cooled by gentle mixing to 150° F. before final packaging. The final product is a hard, tannish-white solid with mild odor and homogeneous form and consistency.

| | |
|---|---|
| Appearance: | Off-White Solid |
| Odor: | Mild Surfactant Aroma |
| Melt Point: | 140–145° F. |
| Acid Value: | 2.0–7.0 |
| Specific Gravity (25 C.): | 0.87–0.88 |
| Penetrometer Hardness (25 C.): | 0.5–1.5 mm |

FURTHER DESCRIPTION OF EXAMPLE 1 LUBRICANT

The chemicals used to prepare the solid film prelube composition of Example 1 are further characterized below:

The refined hydrogenated tallow triglyceride had an iodine value of 1.0, an acid number of 2.5, a saponification number of from a minimum of 193.0 to a 205.0 maximum and a melting point of 140.0°–145° F. and a carbon chain composition as follows: 2.0% $C_{14}$, 0.5% $C_{15}$, 30.0% $C_{16}$2.5% $C_{17}$ and 65.0% $C_{18}$.

The castor oil ester derivative with an acid number of approximately 50.0 was derived from a commercial organic diacid with a molecular weight of 350.0. The ethylene-acrylic acid copolymer was one having an acid number (mg KOH/g) of about 120.0 with hardness (ddm at 25° C.) of 11.5 maximum and a melting point of 92° C. (198° F.). The aromatic polyether is derived from a $C_{15}$ alcohol capped with nine moles of ethylene oxide and fifteen moles of propylene oxide and is fluid at ambient temperature with a specific gravity of 1.0210, molecular weight of 1,482.0 and a cloud point of 20.0° to 24.0° C. (1% in distilled water).

EXAMPLE 2

The lubricant prepared in Example 1 was coated onto various types of steel panels in laboratory as follows by two different methods, Test panels are purchased from major panel manufacturers and are usually 3"×6" or 4"×6" in size. Before coating, all test panels are cleaned with Xylene and hexane. When dry, the panel weight was recorded to 1/10,000th of a gram on a precise analytical balance (such as a Mettler). The lubricant was applied to steel test panel at ambient conditions by one of two methods:

1. Method 1: Placing the test panel on a warm hot plate (surface temperature approximately 200° F.) and brushing lubricant (warmed separately to 170°

F. until lubricant is molten) onto the panel. Standard paint brushes with high melting polyalphaolefin bristles are used. Brushes are either two or three inches wide. An initial heavier application is made to ensure adequate coverage followed by a thirty minute cooling period. The panel is then once again placed on the hot plate and a clean brush used to remove excess coating to reduce coating weight to a specific weight. Panels are then cooled again and placed on the hot plate one final time to reflow the coating.

2. Method 2: Lubricant is dissolved at a specific concentration in a solvent such as trichloroethane by warming the mixture to 160° F. Test panels are immersed in the lubricant-solvent solution for five seconds, withdrawn from the solution and placed in a vertical position. A hot air gun is used to blow warm air over both sides of the test panel (panel held in upright position with a plastic hook and gun held 10–12 inches from metal surface) to dissipate the solvent and reflow the coating.

While being coated, test panels are always handled by the preparer wearing disposable latex gloves to prevent surface metal contamination. Coated panels are allowed to cool at ambient temperatures for sixty minutes. The coated panels were then reweighed again on the same scale and lubricant coating weights are then calculated and reported in milligrams per square foot.

The coated methods described above are adequate for only small laboratory applications and preparations. For commercial applications, the lubricant may be applied by one of three methods:

A. Warming the lubricant above its melt point and applied to a moving steel strip by an electrostatic spray. The steel strip will pass through an insulated chamber containing warm air approximately at 100° F. and dual sets of application spray blades.

B. Diluting the lubricant in a solvent such as Xylene or SC-150 at a concentration of 5.0 to 15.0 weight percent. The moving steel strip is passed through a bath of the lubricant or a series of coating rolls apply the lubricant from the pan onto the strip. A series of ovens are used to dissipate the solvent, reflow the coating and cool the lubricant coating to ambient temperature.

C. Applying the lubricant in a molten form (temperature above the melt point) to a moving steel strip by a series of coating rolls. A series of ovens are used to reflow the coating and a waterfall quench is used to cool the lubricant coating to ambient temperature.

Despite the variety of coating methods, the lubricant, according to the present invention, provides a transparent, smooth film (which is hard yet pliable) on all types of steel with excellent surface adhesion and wetting properties providing a homogeneous and consistent film coating on the metal substrate.

EXAMPLE 3

The lubricant as designed in Example 1 was tested to determine its forming and drawing characteristics using the double draw bead simulator. 2"×12" test strips of commercially produced steels were used of the following: 0.025" cold roll steel, 0.029" two-sided hot dip galvanized and 0.031" two-sided electrolytic galvanized.

Lubricant was applied to an area of 2"×5" on both sides at one end of each strip. Lubricant was applied to strip by warming the strip end on a warm hot plate and brushing molten lubricant on each side of the strip. Test strips were then allowed to cool at ambient conditions for eight hours before testing. Three test strips were produced for each lubricant of each steel substrate type. Average coating weights were 100 +/−10 mg/ft$^2$. Test strips are then drawn through a pair of mated dies containing a series of fixed draw beads. Strips were pulled a total distance of five inches through the dies at the rate of 100 inches/minute. A certain pulling load is necessary to pull the strip versus the load exerted by the paired dies on the test specimen. The coefficient of friction is calculated for each strip, followed by an average coefficient of friction for each set of three test strips for each lubricant and substrate combination.

Four commercial prelubes, three dry film prelubes (acrylic polymer, soap-borax and fatty acid) and one oil-based prelube were also evaluated. In comparison, average coefficients of friction are listed below:

| | AVERAGE COEFFICIENT OF FRICTION | | |
|---|---|---|---|
| LUBRICANT | COLD ROLL STEEL | HOT DIP GALVANIZED | ELECTRO-GALVANIZED |
| Nalco Lubricant #1* | 0.0782 | 0.0989 | 0.0450 |
| Soap-Borax | 0.1163 | 0.1097 | 0.1041 |
| Acrylic Polymer | 0.1421 | 0.1248 | 0.1194 |
| Fatty Acid | 0.0946 | 0.1167 | 0.0743 |
| Oil-Based | 0.1453 | 0.1329 | 0.1023 |

*Example 1. and hereafter

The lubricant described in Example 1 provided better lubricity (based on lower average coefficients of friction) versus four commercial prelubes on all three steel test substrates. Hereinafter Nalco Lubricant #1 is a lubricant of the invention.

EXAMPLE 4

The lubricant prepared as described in Example 1 above was tested to determine whether it would provide the necessary corrosion protection required for metal surfaces during periods of storage and transit in various environmental conditions of humidity and temperature. This test is one of an accelerated nature whereby the exposure to adverse conditions of temperature and humidity are increased thereby reducing the time factor for practical reasons.

Lubricants were tested on 3"×6" panels of four steel substrates: cold roll, hot dip galvanized, electrogalvanized and galvaneal. Panels were purchased from a major panel manufacturer. Prior to coating, panels were cleaned by washing in hexane and then air dried. The lubricant was applied at a coating weight of 200 +/−10 mg/ft$^2$ to one side of each panel as described in Example 2. Panels were then aged 24 hours at ambient temperature prior to testing.

The test chamber consisted of an atmosphere of condensing humidity at 100° F. and 100% relative humidity. The water vapor circulated continually in the chamber, condensing on the coated surfaces of the test panels and washed the coating. The test panels were placed on the chamber with the coated surface facing down for maximum exposure to the condensation.

Panels were always handled while wearing latex gloves to prevent surface contamination on the coatings from oils and salts commonly found on human skin.

Panels were examined visually every 24 hours, and the test concluded when rust, corrosion or staining appeared over more than 5.0 percent of panel surface.

For comparison, as in Example 3, two dry film prelubes (acrylic polymer and soap borax) and one commercial mill oil were also run.

| | CORROSION: DAYS TO FAILURE | | | |
|---|---|---|---|---|
| LUBRICANT | COLD ROLL STEEL | HOT DIP GALVANIZED | ELECTRO-GALVANIZED | GALVANEAL |
| Nalco Lubricant #1 | 7 Days | 7 Days | 12 Days | 6 Days |
| Soap Borax | 4 Hours | 4 Hours | 10 Hours | 5 Hours |
| Acrylic Polymer | 8 Days | 1 Day | 1 Day | 3 Days |
| Mill Oil | 4 Days | 1 Day | 4 Days | 3 Days |

The lubricant described in Example 1 provided excellent corrosion protection under the conditions of temperature and humidity tested on all four substrates versus the two dry film prelubes and one mill oil.

In addition, Phase I corrosion testing for automotive applications have been run and confirmed by independent laboratory testing. These tests are corrosion specifications determined by both Ford and General Motors for automotive approval. The tests and results are summarized below:

A. Ford (Specification M-14B90A-B(F)) consists of 72 hour exposure cycle on Cleveland condensing humidity cabinet on four steel substrates at 100° F. and 100% relative humidity. Lubricant described in Example 1 was tested at coating weight of 300 mg/ft$^2$ versus control mill oil specified at 800–900 mg/ft$^2$. Results were:

| | DEGREE OF CORROSION | |
|---|---|---|
| SUBSTRATE | NALCO LUBRICANT #1 | MILL OIL |
| A. Cold Roll Steel | 3% Pinpoint Rust | 5% Pinpoint Rust |
| B. Hot Dip Galvanized | 5% Edge Stain | 80% Surface Stain |
| C. Electrogalvanized | None | None |
| D. Galvaneal | 2% Edge Stain | 20% Surface Stain |

The lubricant described in Example 1 provided equivalent corrosion protection on all four test substrates versus the control mill oil and would thus meet Ford requirements.

B. General Motors (Specification 52-29) consists of a ten cycle corrosion test one three steel substrates, each cycle consisting of eight hours exposure at ambient temperature and sixteen hours exposure in humidity cabinet at 95° F. and 100% relative humidity. Lubricant described in Example 1 was tested at coating weight of 300 mg/ft$^2$ versus control mill oil specified at 800–900 mg/ft$^2$. Results were:

| | DEGREE OF CORROSION | |
|---|---|---|
| SUBSTRATE | NALCO LUBRICANT #1 | MILL OIL |
| A. Cold Roll Steel | 1% Pinpoint Rust | 1% Pinpoint Rust |
| B. Hot Dip Galvanized | None | 1% Edge Stain |
| C. Electrogalvanized | None | None |

The lubricant described in Example 1 provided equivalent corrosion protection on all three test substrates versus the control mill oil and would thus meet General Motors requirements.

EXAMPLE 5

Steel coils and blanks may be stored under certain field conditions near pickling baths and cleaner lines containing acidic components. These components can lead to atmospheric acid fumes from these baths/lines that can severely stain and corrode the steel. For this reason, lubricant described in Example 1 was tested to determine its effectiveness in protecting cold roll steel substrates from corrosion and staining in acid environments.

A controlled atmosphere test chamber was used. The chamber was charged with separate solutions of deionized water and hydrochloric acid solution which produced a 25 ppm acid vapor in the test chamber. A gear motor rotated a plexiglass paddle which circulated the acid vapor in the chamber. 50 mls. of hydrochloric acid was placed in a central beaker which was surrounded by 200 mls. of deionized water in the chamber bottom. Panels were suspended vertically into the chamber through slots in the chamber lid.

Prior to coating, the panels were cleaned by washing in hexane and then air-dried. 3"×4.5" cold roll steel panels were used as the test substrate. Lubricant described in Example 1 was applied at a coating weight of 300 +/−10 mg/ft$^2$ to one side of each panel as described in Example 2. Coated panels were then stored at ambient temperatures for 24 hours prior to testing. Panels were always handled while wearing latex gloves to prevent surface contamination. The controlled atmosphere test chamber was run for 30 minutes prior to panel insertion to allow the acid atmosphere to equilibrate at 25 ppm concentration.

Panels were then placed in chamber and run for 16 hours. For comparison, two dry film prelubes (acrylic polymer and soap-borax) used in Example 4 and one commercial oil-based prelube used in Example 2 were also run. After the 16 hours exposure, panels were removed and examined visually for the percentage of surface area stained or corroded. Results were:

| LUBRICANT | DEGREE OF STAIN |
|---|---|
| Nalco Lubricant #1 | 10% Stain |
| Soap-Borax | 100% Stain |
| Acrylic Polymer | 100% Stain |
| Oil-Based | 50% Stain |

The lubricant described in Example 1 provided excellent corrosion protection against acid fumes under the conditions tested versus the three commercial prelubes.

In addition, Phase In corrosion testing for automotive applications have been run and confirmed by independent testing. Acid fume corrosion tests are determined by Ford for automotive approval. Specification calls for sixteen hour exposure in acid fume concentration of 25 ppm on four steel substrates. Lubricant described in Example 1 was applied at a coating weight of 300

+/−10 mg/ft² as described in Example 2. Results were:

| | COLD ROLL STEEL | HOT DIP GAL-VANIZED | ELECTRO-GAL-VANIZED | GALVANEAL |
|---|---|---|---|---|
| Nalco Lubri-cant #1 | 10% Stain | None | None | None |

The lubricant described in Example 1 provided excellent corrosion protection against acid fume corrosion on all four substrates and would thus meet Ford requirements.

EXAMPLE 6

Moisture that becomes entrapped between metal layers can cause severe staining and corrosion. For this reason, the lubricant described in Example 1 was evaluated to determine its ability to prevent "metal to metal" contact staining.

All coatings were evaluated on three test substrates: cold roll steel, hot dip galvanized and electrogalvanized. In addition to the lubricant described in Example 1, the two dry film prelubes (soap-borax and acrylic polymer) and mill oil described in Example 4 were run in comparison. Panels of each test substrate were cleaned by washing in hexane and then air dried. Three inch by six inch test panels were prepared, four of each substrate type for each of the four lubricants evaluated. Lubricant was applied at coating weight of 300 +/−10 mg/ft² as described in Example 2 to both sides of each panel. Panels were aged for 24 hours at ambient temperature prior to testing. Coated panels were always handled while wearing latex gloves to prevent surface contamination of the coatings.

Four panels of each coated substrate type were stacked together, one on top of the other. Each stack was held together with four Hoffman "C" clamps, one on each side of the bundled panels. The clamps were finger-tightened and placed in a gravity convection over at 120° F. After 24 hours, the stacks were disassembled and the panels examined for signs of staining. If no staining was found, the stacks were reassembled and placed again in the oven. The stacks were disassembled at seven day intervals, at which time each panel was visually examined for staining. The test was concluded after four weeks. The stack-stain results for the four lubricants are listed below:

| | DEGREE OF STAIN | | |
|---|---|---|---|
| LUBRICANT | COLD ROLL STEEL | HOT DIP GAL-VANIZED | ELECTRO-GALVANIZED |
| Nalco Lubricant #1 | No Stain | No Stain | No Stain |
| Soap-Borax | Stain | Stain | Stain |
| Acrylic Polymer | Stain | Stain | Stain |
| Mill Oil | No Stain | No Stain | No Stain |

The lubricant described in Example 1 provided protection against "metal to metal" contact staining under the conditions tested versus the three commercial lubricants.

EXAMPLE 7

The total removability of a prelube coating from a metal substrate is extremely important because trace amounts of a coating could interfere with future processing operations. In the appliance industry, these operations can include painting and the deposition of porcelain enamel coatings. In the automotive industry, these operations can include the use of body structural adhesives, deposition of phosphate coatings and various types of paint coatings including electrically applied primers and top coats.

For this reason, the lubricant prepared in Example 1 was tested for its removability via several cleanability tests with the goal in mind of improving solid film prelube cleanability at lower temperatures. These tests and results are summarized below:

A. Cleanability was evaluated by the used of surface carbon values as an indication of surface cleanliness. Cold roll steel panels were coated with the lubricant described in Example 1 via the hot melt method described in Example 2. In addition, a past Nalco solid film prelube was also evaluated for comparative purposes. Lubricants were applied to 3"×6" panels (cleaned in hexane and air-dried) on one side of the panels at a coating weight of 150 mg/ft². These panels were exposed to a commercial alkaline automotive cleaner at 120° F. for 60 seconds at a concentration of one ounce of cleaner per one gallon of deionized water. Panels were exposed in a power spray wash unit at a spray pressure of 20 psi. Panels were then rinsed under deionized water of 30 seconds at 110° F. Panels are then wiped with filter pads soaked in a concentrated hydrochloric acid solution which removes any surface residual carbon left on the metal substrate which was not removed by the alkaline cleaner. The lower the surface carbon value (in milligrams of carbon per square foot), the better the cleanability.

| | SURFACE CARBON VALUES | |
|---|---|---|
| LUBRICANT | SUBSTRATE #1 | SUBSTRATE #2 |
| Past Solid Film* | 0.697 | 0.731 |
| Nalco Lubricant #1 | 0.324 | 0.320 |

*Nalco (Sech) Patent No. 4,753,743

The lubricant described in Example 1 exhibited lower surface carbon values and improved cleanability at 120° F. versus past solid film prelube.

B. Cleanability was evaluated at coating weights of 50, 100 and 150 mg/ft² on a galvanized steel substrate panels run through an alkaline cleaner line at a major automotive manufacturer. The panels were exposed to a commercial alkaline cleaner for four minutes at 130° F. The panels were then run through phosphate treatment line, and the phosphate coatings were evaluated by visual examination, phosphate coating weights and scanning electron microscope photos of the coatings. Phosphate coatings will be uniform in appearance, structure and adhesion only if lubricant coating has been completely removed from the metal substrate prior to phosphate deposition. Results are summarized below:

| PANEL | PHOSPHATE COATING WEIGHT ($MG/FT^2$) |
|---|---|
| A. 50 $mg/ft^2$ Control | 602.7 |
| B. 50 #2 | 486.0 |
| C. 50 #3 | 567.7 |
| D. 100 $mg/ft^2$ Control | 502.9 |
| E. 100 #2 | 528.1 |
| F. 100 #3 | 538.9 |
| G. 150 $mg/ft^2$ Control | 533.8 |
| H. 150 #2 | 556.9 |
| I. 150 #3 | 511.2 |

Phosphate coating weights were very consistent at all three solid lubricant coating weights. SEM photos revealed coatings very homogeneous and consistent with uniform crystal size.

The solid film lubricant described in Example 1 showed acceptable cleanability and phosphatability.

EXAMPLE 8

Besides compatibility with processing cleaning systems, prelubes must also be compatible with structural body adhesives used to bond automotive body components together. Lubricant prepared in Example 1 was evaluated for compatibility with structural body adhesives versus a commercial mill oil/drawing compound in a major automotive test specification. Strips of two side electrogalvanized steel, 1"×4" panels, were cleaned with toluene and air dried. Lubricant described in Example 1 was applied by hot melt method described in Example 2 to top one inch side of several test strips at coating weights of 100 $mg/ft^2$. Oil-based combination was applied to top one side of an equal number of test strips by dipping the strips in the mill oil, draining overnight and then applying drawing compound via a draw bar over the mill oil. Over each of the lubricated test strip ends, a commercial structural body adhesive used in the automotive industry was applied in strips one-half inch wide. Wire spacers (0.005 inch stainless steel) were then laid in the adhesive, parallel to the length of the test strips and extending beyond the end of the strip. To the adhesive side of each prepared strip, a clean strip (with no lubricant coating or body adhesive) was clamped. The two strips overlap for one inch and are oriented in the same direction. Clamping the strips forces the adhesive to wet out on entire strip surface and excess adhesive is forced out at strip edges. The two strips are clamped together with adhesive with a gap between the strips equal to the diameter of the wire spacers. The panel sets are baked in an oven for one hour at 240° F. and then cooled at ambient temperature for 24 hours prior to testing. For each lubricant tested, twenty clamped sets were prepared.

A. Ten sets are aged at ambient conditions of 168 hours.

B. Ten sets are immersed in water at 130° F. for 168 hours and then allowed to recover for 24 hours at ambient temperature.

After aging, the strip sets are pulled apart in an Instron Shear Tester to determine the failure point of the adhesive bonding the strips (the force required to pull the strips apart, breaking the adhesive bond). The strips were pulled apart at a uniform rate of one-half inch per minute, starting at a minimum distance of four inches between the jaws. The failure point of the body adhesive must be a uniform failure, the breaking point ocurring at the ends of the strips between the adhesive, with adhesive remaining on both strip surfaces. For strip sets aged at ambient temperature, failure of the adhesive bond must be 1,000 psi or higher, or is considered a commercial failure. For strip sets immersed in water, failure of the adhesive bond must be 500 psi or higher, or is considered a commercial failure. Results are summarized below:

| | NALCO LUBRICANT #1 | OIL SERIES |
|---|---|---|
| A. Ambient Temperature | | |
| Average Bond Stress | 2,514 psi | 2,375 psi |
| Failure Point Range (psi) | 2,274–2,610 | 2,314–2,444 |
| B. Water Immersion | | |
| Average Bond Stress | 2,293 psi | 2,036 psi |
| Failure Point Range (psi) | 2,202–2,406 | 1,954–2,074 |

The lubricant described in Example 1 provided better adhesive compatibility with the structural body adhesive then the combination of mill oil and drawing compound currently being used.

EXAMPLE 9

The lubricant described in Example 1 was tested for compatibility with the paint primers that are electrically applied in the automotive industry. Trace amounts of prelube left on the metal substrate during E-coat primer deposition could volatilize during the primer baking stage in over, causing craters, distortions or irregularities in the primer paint film. 4"×12"×0.032" phosphated cold roll steel test panels produced by a commercial panel manufacturer were used for the test and a commercially used prelube in automotive industry was used as the control lubricant. Three panels were run for each lubricant plus a blank control panel. Lubricant described in Example 1 was applied via hot melt method described in Example 2 to an area on the bottom of panel, 4"×6" rectangular in shape, one-half inch in from panel edges at coating weight of 100 $mg/ft^2$. Commercial prelube was applied at an average coating weight of 500 $mg/ft^2$. Over the coated area, a clean 4"×6" panel of same substrate was placed and held in place by platers tape. The panel sets were immersed in a bath of commercial electrostatic primer for three minutes at 75° F., and a voltage of 250 volts was applied until a film thickness of 1.2 mils was obtained. Panel setups were then baked in forced air oven at 360° F. for 20 minutes. After cooling to ambient temperature, the setups were disassembled and the 4"×6" primer area examined visually for the number of craters. The commercially acceptable number of craters for a panel in this test setup is 25 for coating weights up to 500 $mg/ft^2$. Above 25, the primer film distortion is considered unacceptable. Results are summarized below:

| LUBRICANT | NUMBER OF CRATERS |
|---|---|
| A. Nalco Lubricant | |
| #1a. | 5 |
| #1b. | 4 |
| #1c. | 5 |
| Control | 1 |
| B. Commercial Prelube | |
| A. | 17 |
| B. | 11 |
| C. | 13 |

-continued

| LUBRICANT | NUMBER OF CRATERS |
|---|---|
| Control | 0 |

The lubricant described in Example 1, based on the above test results, was more compatible with the commercially used E-coat primer than the oil-based prelube now being used.

EXAMPLE 10

In addition, trace amounts of lubricant cannot interfere with the welding of structural components together, both in the appliance and automotive industries. The lubricant should not affect the quality, composition or size of the weld itself nor buildup on welding tips nor create any noxious of hazardous fumes upon vaporization of decomposition when exposed to heat or flame from the welding process. The lubricant described in Example 1 was applied via hot melt method described in Example 2 at a coating weight of 100 mg/ft$^2$ on hot dip galvanized test panels. A commercial mill oil was used as the control on the same substrate at a coating weight of 1,000 mg/ft$^2$. The products were evaluated in a welding test from a major automotive manufacturer. The solid film prelube described in Example 1 had no negative effects on the welding process: no deviation in the current, no buildup on welding tips and no deviation in weld nugget size. The lubricant described in Example 1 was compatible with the welding cycle process used and offered equivalent performance to the commercial mill oil.

Further chemical analysis of gaseous by-products from decomposition of the solid film lubricant described in Example 1 are the single end products of normal long chain hydrocarbon breakdown, water and carbon dioxide. Both by-products are non-hazardous.

EXAMPLE 11

SEM (scanning electron microscope) photos of solid lubricant coatings can be used as a firm indicator of film morphology, coverage rates on the metal substrate and performance characteristics. Photos were taken of solid film lubricants at magnifications of both 100× and 500× in both sectional and backscatter modes of the lubricant described in Example 1 and three commercial solid film lubricants: acrylic polymer, soap-borax and fatty acid ester. The appearance and morphology of a solid film lubricant (surface contours, presence and number of pores or craters, presence of layers, striations or gaps in coating) plays a key role in the performance of that film, especially regarding corrosion protection, lubricity and cleanability (and its effects on all processing operations). Soap-borax film appears as an inconsistent film, with large areas of exposed metal substrate present. The coating lacks uniformity and contains a large proportion of pores in the coating. Acrylic polymer film appears with varying surface contours and contains a large number of cracks and pores in the coating. Fatty acid ester film appears as a series of mesas, varying in size and air distribution. No pores are present but there are wide gaps between some of the surface mesas.

The solid film lubricant described in Example 1 is homogeneous and uniform in structure and morphology. The coating closely follows the surface contours of the metal substrate and contains no gaps, cracks or pores. There is a defined lack of any surface features such as hills or valleys. The lubricant described in Example 1 is more uniform and homogeneous than those of competitive solid film lubricants and the consistent coating allows for the desirable performance properties it exhibits.

EXAMPLE 12

In addition, trace amounts of lubricant entering the plant waste treatment process cannot interfere with the overall treatment process nor the individual chemicals used in the process. The lubricant should not react or interfere with the major components of the waste stream itself. The lubricant described in Example 1 was evaluated in a standard laboratory A-V emulsion test for waste treatability. A standard aqueous alkaline cleaner was used as the major stream component as it would be under realistic field conditions in the automotive and appliance industries. Samples were treated at two dosage levels (5,000 [0.5%] and 10,000 [1.0%] ppm). The samples were treated with aluminex and pH adjusted to 8.0, followed by treatment with a standard cationic waste treatment polymer and skimming of the solids, C.O.D.'s, (chemical oxygen demand) values were then determined for the clear water solutions from the treatment process. Results are summarized below:

| TEST SOLUTION | PRODUCT DOSAGE | ALUMINEX (ppm) | C.O.D. (ppm) |
|---|---|---|---|
| 0.8% Alkaline Cleaner | 0.5% | 1,200 | 210 |
| | 1.0% | 1,200 | 220 |
| 0.8% Alkaline Cleaner | 0.5% | 1,200 | 140 |
| Plus 1.0% Nalco Lubricant #1 | 1.0% | 1,200 | 270 |

As can be seen, the solid film lubricant described in Example 1 has no negative impact on treatment product dosage levels or on effluent C.O.D. values. The lubricant described in Example 1 will have no ill effects on standard waste treatment processes and itself will be easy to waste treat.

In the above examples, the castor oil ester is a plasticizer and is the same as that of U.S. Pat. No. 4,753,743, namely, one formed with organic diacids, molecular weight about 250 to 500, an acid number of 45 to 60, formed by the partial esterification of castor oil with organic diacid of about 340–360 molecular weight. According to the same patent (col. 5) an ethoxylated ($C_{10}$–$C_{20}$) alcohol is deemed to be another plasticizer in addition to the partially esterified caster oil.

According to example 1 of the present disclosure, and as set forth above, I employ, as a surfactant, a modified aromatic polyether formed of an aromatic alcohol containing a hydrophobe carbon chain containing from 10 to 20 carbon atoms containing 5 to 15 moles of ethylene oxide and 10 to 20 moles of propylene oxide per mole of alcohol for the purpose of greatly improved cleanability under the present invention, having no role as a plasticizer. The improved cleanability is given in example 7.

Further to exhibit the present improvements, thirteen formulations were tested as will now be set forth.

A. Sech (U.S. Pat. No. 4,753,743) formulation.

B. MX-253 formulation, the same as in example 1 hereof. Formulations C through F used the maximum top end value of 15.0% weight value from 5.0 to 15.0% castor oil ester plasticizer range for these four formulations. Blends were made using a 2.5% increments totaling 15.0% by weight of the castor oil ester and the EO/PO alcohol identified above. The purposes of testing these four formulations is to view the effect of increasing levels of EO/PO alcohol in formulation upon product performance under the present invention, specifically in the areas of corrosion performance and cleanability. The 5.0% by weight level of EO/PO alcohol in example 1 above provided excellent cleanability without affecting corrosion performance of the applied coating; see example 4 above.

The 5.0% level proved to be the optimal level for performance. As EO/PO alcohol levels are increased in the formulation, cleanability should remain excellent. However, one would expect to see significant drops in corrosion protection since the increasing levels if EO/PO alcohol in the formula will increase water sensitivity of the coating. As the coating becomes more hydrophilic, corrosion protection would significantly be affected. Formulas are listed below:

| | Percentage by Weight | | | | |
|---|---|---|---|---|---|
| | C | D | E | F | G |
| Refined Tallow Triglyceride | 83.0 | 83.0 | 83.0 | 83.0 | 85.0 |
| Caster Oil Ester | 7.5 | 5.0 | 2.5 | — | 10.0 |
| EO/PO Alcohol | 7.5 | 10.0 | 12.5 | 15.0 | 3.0 |
| Hindered Phenol | 1.0 | 1.0 | 1.0 | 1.0 | 1.0 |
| EVA Copolymer | 1.0 | 1.0 | 1.0 | 1.0 | 1.0 |

Formula G viewed the effects of reducing the EO/PO alcohol in the submitted formulation from 5.0 to 3.00% by weight. One would expect to see corrosion protection similar to the formula of example 1 above but with a decrease in the EO/PO alcohol affecting cleanability to the point of seeing a reduction in the percentage of coating removed. Formula G contained 85.0% refined tallow triglycerides, 10.0% of castor oil ester, 3.0 of EO/PO alcohol and 10% by weight each of hindered phenol and EVA copolymer. Formula H was identical to G except the EO/PO alcohol was replaced by the ethoxylated alcohol from Sech and increased to 5.0% by weight. One would expect to see no changes in cleanability since the surfactants are present at same level. However, because the ethoxylated alcohol is more water soluble versus the EO/PO alcohol, one would expect to see a drop in corrosion protection. The 15 moles of propylene oxide on the EO/PO alcohol significantly reduces water solubility versus that of the solely ethoxylated alcohol according to Sech. Formula H consisted of 83.0% refined hydrogenated tallow triglyceride, 1.0% each of hindered phenol and EVA copolymers, 10.0% of castor oil ester and 5.0% of Sech's ethoxylated alcohol.

Formulas I through M also utilize the top range limit of 15.0% by weight for plasticizer blends used earlier. These formulations contain blends of the castor oil ester and the ethoxylated alcohol of Sech. The blends were made using 2.5% increments totaling 15.0% by weight of the castor oil ester and the ethoxylated alcohol. The tallow triglyceride from Sech was used in these remaining five formulations. One would expect to see significant improvements in cleanability in these formulations versus that seen for Sech. The Sech formula contained no ethoxylated alcohol so its presence should contribute to significant cleanability improvements. On the same hand, one would also expect to see poor corrosion protection. As the ethoxylated alcohol levels increase, corrosion protection for these five formulations versus that of the original formulation would expect to be compromised. Formulas are listed below:

| | H | I | J | K | L | M |
|---|---|---|---|---|---|---|
| Tallow Triglyceride | 83.0 | 83.0 | 83.0 | 83.0 | 83.0 | 83.0 |
| Ethoxylated Alcohol | 5.0 | 5.0 | 7.5 | 10.0 | 12.5 | 15.0 |
| Castor Oil Ester | 10.0 | 10.0 | 7.5 | 5.0 | 2.5 | — |
| Hindered Phenol | 1.0 | 1.0 | 1.0 | 1.0 | 1.0 | 1.0 |
| EVA Copolymer | 1.0 | 1.0 | 1.0 | 1.0 | 1.0 | 1.0 |

Corrosion evaluations were run in the Cleveland condensing humidity cabinet as described in Example 4 of the parent application. Evaluations were run on cold rolled steel test panels (4.0 by 6.0 inch General Motors panels from ACT) at coating weight of 150# 10 mg/ft$^2$. Panels were exposed for a 72 hour consecutive period followed by visual examination. Cleanability evaluations were run via static bench tests. Test panels were prepared as described above on the same substrate at coating weight of 150# 10 mg/ft$^2$. Test baths (200 ml in volume) were prepared by placing 1000 ml of aqueous alkaline test solution (Parker-Amchem PARCO 233/cleaner at concentration of one ounce per gallon in deionized water]in bath. Baths were maintained at 130# 1° F. using static heat and stir bars as a source of bath agitation. Panels were immersed approximately 50% into test bath for 60 seconds. The panels were then rinsed in a deionized water rinse for 30 seconds at 110° F. The panels were then immersed approximately 20% into a saturated copper sulfate solution (aqueous solution of saturated copper sulfate with pH adjusted to 6.5 with hydrochloric acid). The panels were then visually examined for signs of coating removal and the nature of the copper coating. A uniform copper coating will be deposited on all metal surfaces devoid (cleaned) of coating by the alkaline cleaner solution. Areas still partially covered by solid prelube film will either have no copper coating or a mottled coating Results for all formulas are summarized below:

The following conclusions apply:

A. Original John Sech patent (U.S. Pat. No. 4,753,743) offered excellent corrosion protection (See Photo 1) with no pinpoint corrosion present after 72 hours exposure. Cleanability for this formulation however was marginal (See Photo 8). There was a poor line of interface between coated and cleaned areas with unremoved coating. The copper coating on the bottom of the panel was mottled with unremoved coating present on panel edges.

B. By example 1 above excellent corrosion protection is achieved (see photo 2) with no pinpoint corrosion present after 72 hours exposure. Cleanability at 130° F. was excellent (see Photo 9) with complete coating removal and a uniform, homogeneous copper coating. This documents that the EO/PO alcohol used in example 1 provides superior cleanability at the 5.0% by weight level. In addition, the combination of that specific ethoxylated/propoxylated alcohol at the 5.0% by weight level did not compromise or hinder corrosion protection in any negative manner.

C. Formulations C through F revealed that increasing the EO/PO alcohol in MX-253 from 5.0 to 15.0% by weight did not compromise cleanability performance. All panels exhibited clear lines of interface with total coating removal. Copper coatings were homogeneous. Photos 12 and 13 document those results illustrating results for EO/PO levels of 7.5% and 15.0% by weight. However, increasing the EO/PO alcohol levels from 5.0% to 15.0% by weight did compromise corrosion protection. Photos 5 and 6 exhibit the extensive pinpoint corrosion present on both panels for EO/PO alcohol levels of 7.5 and 15.0% by weight respectively. Increasing the surfactant level beyond the optimal 5.0% by weight caused the coating to become too hydrophilic. This in turn initiated the type of pinpoint corrosion which developed.

D. Formulations I through M revealed that incorporating and increasing the ethoxylated alcohol in the Sech formulation as a plasticizer (replacing the castor oil ester used) dramatically affected coating performance. The ethoxylated alcohol was present at levels from 5.0 to 15.0% by weight. On the plus side, incorporating the ethoxylated alcohol in Sech improved cleanability (see Photos 10 and 11). Both the panels exhibited the excellent cleanability with clear lines of interface and uniform copper coatings. Cleanability was thus improved over that of the Sech (U.S. Pat. No. 4,753,743). However, panels exhibited extensive pinpoint corrosion at all levels of the incorporated ethoxylated alcohol (see Photos 3 and 4). Thus if the ethoxylated alcohol listed in Sech was actually used in the formulation as a replacement for the castor oil ester plasticizer, performance of the coating would be jeopardized. Cleanability would improve slightly but the ethoxylated alcohol would cause the coating to become so hydrophilic that corrosion protection would be nil.

E. Formulation G and H reveal the most dramatic results. In formula G, the EO/PO alcohol was reduced from 5.0% to 3.0% by weight in the MX-253 formula. Table results indicate corrosion protection remained equivalent with no pinpoint corrosion present. However, decreasing the EO/PO alcohol did affect cleanability slightly, with a drop from 100% to 95% cleanability. These results again confirm that the 5% by weight level of the ethoxylated-propoxylated alcohol in the MX-253 test (example 1) provides optimal performance in the areas of both corrosion protection and cleanability.

Formulation H provides striking evidence for the differences in performance between the Sech ethoxylated alcohol and the EO/PO alcohol in MX-253. In H, the Sech alcohol replaced the EO/PO alcohol at the same level of 5.0% by weight used in Formula B. There were no differences in cleanability, with Formula H exhibiting excellent cleanability (see Photo 14). With the surfactants present at the same level, cleanability performance was equivalent. Photo 7 truly exhibits the negative effects of switching alcohols. Formula H offers no corrosion protection, exhibiting extensive pinpoint corrosion. Switching from EO/PO alcohol to Sech's ethoxylated alcohol significantly increased the hydrophilic characteristics of the coating, destroying corrosion protection. These results should clearly illustrate that the presence of propylene oxide on the EO/PO alcohol used in MX-253 allows for balanced performance properties of cleanability and corrosion protection. Using a simple ethoxylated alcohol as a plasticizer as intended in Sech only results in mixed performance results. Cleanability is improved but the hydrophilic nature of the ethoxylated alcohol destroys coating corrosion performance. This is simply not acceptable since the coating must offer balanced properties of both corrosion protection and cleanability as stated hereinabove.

CHART
Example/Figure Order and EO/PO or EO Amount

| Example | Figure (Photo) | EO/PO | EO |
|---|---|---|---|
| A (Sech Patent) | 1, 8 | — | 5 |
| B | 2, 9 | 5 | |
| C | 5, 12 | 7.5 | |
| D | — | 10 | |
| E | — | 12.5 | |
| F | 6, 13 | 15.0 | |
| | — | 3.0 | |
| G | 7, 14 | — | 5 |
| I | 3, 10 | — | 5 |
| J | — | — | 7.5 |
| K | — | — | 10 |
| L | — | — | 12.5 |
| M | 4, 11 | — | 15 |

I claim:

1. A hot-melt lubricant to be liquified, applied in the liquid state to a steel substrate to be fabricated, cooled on the substrate to provide a flexible prelubricating solid film removed by a hot alkaline solution after fabrication, and consisting essentially of the following in weight percent:

hydrogenated tallow triglyceride lubricant which is the reaction product of an aliphatic polyhydric alcohol and $C_2$–$C_{26}$ carboxylic acids, 80–90% esterified castor oil plasticizer, 4–14%; and an aromatic polyether surfactant which is the reaction product of an aromatic alcohol having a $C_{14}$–$C_{20}$ hydrophobe carbon chain with 5 to 15 moles of ethylene oxide and 10 to 20 moles of propylene oxide per mole of alcohol, about 5%.

2. A lubricant according to claim 1 containing, in weight percent, 0.1–2% ethylene-acrylic acid copolymer film strengthener.

3. A lubricant according to claim 1 containing, in weight percent, 0.1–3% hindered phenol rust inhibitor.

4. A lubricant according to claim 3 containing, in weight percent, 0.1–2% ethylene-acrylic acid copolymer film strengthener.

5. A method of prelubricating a steel substrate to be fabricated comprising the steps of preparing a dry hot-melt lubricant consisting essentially of (weight percent) hydrogenated tallow triglyceride lubricant which is the reaction product of an aliphatic polyhydric alcohol and $C_2$–$C_{26}$ carboxylic acids, 80–90%;

esterified castor oil plasticizer, 4–14%; and an aromatic polyether surfactant which is the reaction product of an aromatic alcohol having a $C_{14\text{-}20}$ hydrophobe carbon chain with 5 to 20 moles of ethylene oxide and 10 to 20 moles of propylene oxide per mole of alcohol, about 5%;

coating said lubricant on a steel substrate, which substrate has been heated to a temperature of about 165° F.; passing the coated substrate through an oven to reflow the coating;

cooling the substrate following reflow to transform the coating to a dry lubricating film;

fabricating the substrate containing the dry lubricating film to produce a predetermined steel configuration; and removing the lubricating film from the configuration with an alkaline solution at a temperature of about 120° F.–140° F.

6. A method according to claim 5 in which the dry lubricant contains 0.1-2 weight percent ethylene-acrylic acid film strengthener.

7. A method according to claim 6 in which the dry lubricant contains 0.1-3 weight percent hindered phenol antioxidant.

8. A method according to claim 7 in which the dry lubricant contains 0.1-2 weight percent ethylene-acrylic acid film strengthener.

9. A lubricant according to claim 1 wherein the triglyceride component contains at least 90% $C_{14}$-$C_{22}$ carboxylic acids.

10. A lubricant according to claim 1 wherein the surfactant is the reaction product of a $C_{14}$-$C_{20}$ alcohol with 5 to 15 moles of ethylene oxide per mole of alcohol and 10 to 20 moles of propylene oxide per mole of alcohol.

11. A method according to claim 5 wherein the triglyceride component contains at least 90% $C_{14}$-$C_{22}$ carboxylic acids.

12. A method according to claim 5 wherein the surfactant is the reaction product of a $C_{14}$-$C_{20}$ alcohol with 5 to 15 moles of ethylene oxide per mole of alcohol and 10 to 20 moles of propylene oxide per mole of alcohol.

* * * * *

UNITED STATES PATENT AND TRADEMARK OFFICE

CERTIFICATE OF CORRECTION

PATENT NO. : 5,069,806

DATED : Dec. 3, 1991

INVENTOR(S) : Robert L. Trivett

It is certified that error appears in the above—identified patent and that said Letters Patent is hereby corrected as shown below:

Col. 2, line 23, "out" should be --cut--.

Col. 4, line 39, after "prelube" insert --compositions are often--;

line 40, cancel "automotive and appliance".

Col. 5, line 17, change "provides" to --provided--.

Col. 6, line 59, change "includes" to --include--.

Col. 9, line 37, change "comprises" to --comprised--.

Col. 10, line 38, change "compositions" to --composition--.

Col. 11, line 11, change "lubricants" to --lubricant--;

line 27, change "8.0" to --80.0--.

Col. 15, line 49, change "one" to --on--.

Col. 16, line 62, change "In" to --I--.

Col. 17, line 44, change "over" to --oven--.

Col. 18, line 18, change "used" to --use--.

Col. 19, line 51, change "240" to --340--.

Col. 20, line 31, change "over" to --oven--.

Col. 24, line 42, add table on accompanying page.

UNITED STATES PATENT AND TRADEMARK OFFICE

CERTIFICATE OF CORRECTION

PATENT NO. : 5,069,806

DATED : Dec. 3, 1991

INVENTOR(S) : Robert L. Trivett

It is certified that error appears in the above-identified patent and that said Letters Patent is hereby corrected as shown below:

| Formula | Degree of Corrosion | Cleanability |
|---|---|---|
| A (Sech) | None | 85% Clean, mottled coating |
| B (Example 1) | None | 100% Clean, uniform coating |
| C | 100% pinpoint corros. | 100% Clean, uniform coating |
| D | 100% pinpoint corros. | 100% Clean, uniform coating |
| E | 100% pinpoint corros. | 100% Clean, uniform coating |
| F | 100% pinpoint corros. | 100% Clean, uniform coating |
| G | None | 95% Clean, moderate ctg. |
| H | 100% pinpoint corros. | 100% Clean, uniform coating |
| I | 100% pinpoint corros. | 100% Clean, uniform coating |
| J | 100% pinpoint corros. | 100% Clean, uniform coating |
| K | 100% pinpoint corros. | 100% Clean, uniform coating |
| L | 100% pinpoint corros. | 100% Clean, uniform coating |
| M | 100% pinpoint corros. | 100% Clean, uniform coating |

Signed and Sealed this

Sixteenth Day of March, 1993

*Attest:*

STEPHEN G. KUNIN

*Attesting Officer*

*Acting Commissioner of Patents and Trademarks*